US005237341A

United States Patent [19]

Iwagami et al.

[11] Patent Number: 5,237,341

[45] Date of Patent: Aug. 17, 1993

[54] NOZZLE ORIFICE PROTECTION IN AN INK JET SYSTEM

[75] Inventors: Fusao Iwagami, Nara; Masaharu Kimura, Daito, both of Japan

[73] Assignee: Sharp Kabushiki Kaisha, Osaka, Japan

[21] Appl. No.: 515,675

[22] Filed: Apr. 26, 1990

Related U.S. Application Data

[63] Continuation of Ser. No. 849,791, Apr. 9, 1986, abandoned.

[30] Foreign Application Priority Data

Apr. 13, 1985 [JP] Japan ..... 60-79022
Apr. 13, 1985 [JP] Japan ..... 60-79023

[51] Int. Cl.[5] ..... B41J 2/165
[52] U.S. Cl. ..... 346/140 R
[58] Field of Search ..... 346/140 R

[56] References Cited

U.S. PATENT DOCUMENTS 4,148,041 4/1979 Rosenstock ..... 346/140
4,524,365 6/1985 Kakeno ..... 346/140 X
4,540,997 9/1985 Biggs ..... 346/140
4,551,734 11/1985 Causley ..... 346/140
4,571,600 2/1986 Hara ..... 346/140
4,586,058 4/1986 Yamazaki ..... 346/140

FOREIGN PATENT DOCUMENTS 2842594 5/1982 Fed. Rep. of Germany .
3316969 11/1983 Fed. Rep. of Germany .
3339031 5/1984 Fed. Rep. of Germany .

*Primary Examiner*—Joseph W. Hartary

[57] ABSTRACT

A nozzle orifice protective apparatus comprises a cap for covering an ink nozzle which cap is supplied with maintenance solution, and a maintenance solution tank for storing maintenance solution. The maintenance solution tank is made of a flexible bag and contains a specified volume of gas as well as the maintenance solution, facilitating accurate detection of the amount of solution remaining in the tank. Thus, the maintenance solution tank is simple in construction and inexpensive to manufacture.

A water-absorbing polymer is placed a waste collecting tank case so that it absorbs waste liquid such as maintenance solution and ink led from the cap into the tank case. Since the polymer which has absorbed the liquid becomes gel, replacement of the waste collecting tank case and the subsequent waste disposal are extremely simple and easy.

4 Claims, 4 Drawing Sheets

NOZZLE ORIFICE PROTECTION IN AN INK JET SYSTEM

This application is a continuation of application Ser. No. 06/849,791 filed on Apr. 9, 1986 now abandoned.

BACKGROUND OF THE INVENTION

1. Field of the Invention

The present invention relates to an ink jet printer which sprays ink through the nozzle onto the paper for printing according to printing signals, and more particularly to a nozzle orifice protective apparatus for protecting the nozzle orifice from air and preventing ink in the nozzle from drying and solidifying while the printer is turned off for transportation or storage or while the printer is long out of service with power on.

More specifically, the invention relates to an ink jet printer which is equipped with a cap for covering the nozzle to prevent clogging, the cap being supplied with maintenance solution to protect ink in the nozzle from dryness and solidification.

2. Description of the Related Art

The ink spray nozzle of an ink jet printer is exposed to the atmosphere when the printer is not used. Ink in the nozzle therefore dries and solidifies, causing the clogged nozzle. Solidification of ink can also occur during transportation or storage of the printer.

To prevent the clogging, the conventional ink jet printer is equipped with a cap member for covering the nozzle face when the printer is turned off or long out of service with power on so that ink in the nozzle may not be dried and solidified.

The present engineering group has proposed a nozzle protective apparatus in the Japanese Patent Application No. SHO60-27397. According to this application, the nozzle is protected by the cap member filled with maintenance solution composed of solvent such as water or antimold agent so that ink in the nozzle does not solidify while the printer is not used. The maintenance solution is collected from the cap member into a waste tank when printing operation is started.

The corresponding U.S. patent application "INK JET PRINTER NOZZLE CLOG PREVENTIVE APPARATUS" Ser. No. 828,889 was filed Feb. 13, 1986 by Fusao IWAGAMI and Minoru SAKAMA, now U.S. Pat. No. 4,734,718 and assigned to the same assignee as the present invention. The German counterpart was filed Feb. 12, 1986 and assigned an Application No. P36 04 373.7.

The proposed apparatus is not provided for disposal of waste maintenance solution collected from the apparatus, and therefore presents problems as to waste maintenance solution handling and disposal.

OBJECTS AND SUMMARY OF THE INVENTION

Objects of the Invention

An object of the present invention is to provide a nozzle orifice protective apparatus with an improved maintenance solution supply system or more specifically with a maintenance solution tank which is easy and inexpensive to manufacture and equipped for more accurate detection of the solution shortage.

Another object of the present invention is to provide a waste collecting apparatus which is designed for easy disposal of the collected waste and which can be made small in size.

Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

Summary of the Invention

An embodiment of the present invention comprises a nozzle orifice-covering cap, a system for supplying maintenance solution to the cap and a maintenance solution tank composed of a flexible bag in which a specified volume of gas is sealed together with the maintenance solution. According to the present invention, the remaining maintenance solution in the tank is accurately detected, and the tank is simple in construction and inexpensive to manufacture.

Furthermore, water-absorbing polymer is placed within a tank case into which waste maintenance solution and waste ink are led from the cap. The water-absorbing polymer absorbs the waste liquid to become gel, so that replacement of the waste liquid tank case and disposal of the waste liquid are extremely easy.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
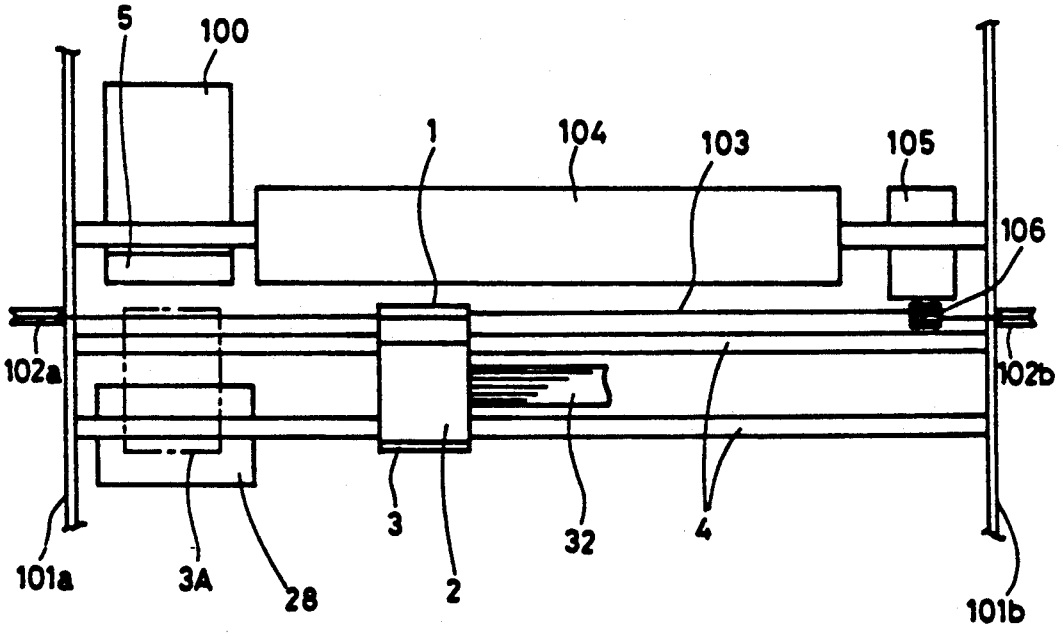
FIG. 1 is a plan view of the printing section of an on-demand type ink jet printer related to the present invention.
Figure 2:
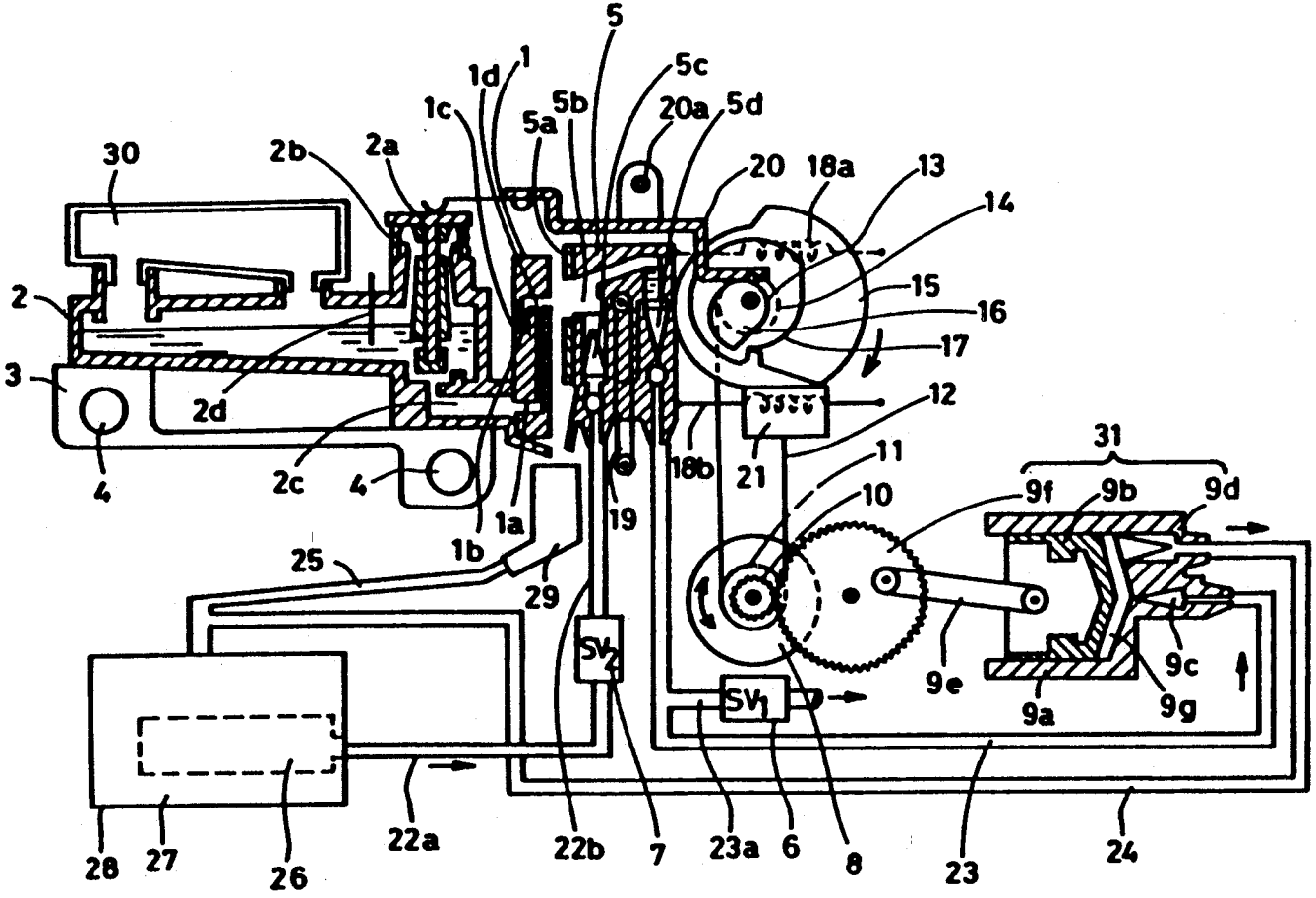
FIG. 2 shows the construction of the nozzle orifice protective apparatus provided in the printer of FIG. 1.

FIG. 1 is a plan view of the printing section of an on-demand type ink jet printer related to the present invention and FIG. 2 shows the construction of a nozzle orifice protective apparatus mounted on the printer of FIG. 1.

Referring to FIG. 1, a platen 104 is rotatably supported by frames 101*a* and 101*b*. A rotary mechanism (not shown) is connected to the platen 104 to control its rotation for paper feeding.

Two shafts 4, 4 are mounted in parallel to the platen 104 between the frame 101*a* and 101*b*, and a carriage 3 is slidably supported by the shafts 4. The carriage 3 is provided with a wire 103 which is extended around a drum 106 connected to the rotary shaft of a motor 105 and around pulleys 102*a* and 102*b*. Rotation of the motor 105 causes the carriage 3 to reciprocate for printing in the printing zone (travelling zone) to the right of the home position 3A and to return to the home position 3A when printing is not conducted (in standby period).

A printing head 1 having an ink spray nozzle opening (orifice) is mounted on the front of the carriage 3, facing the platen 104. The nozzle opening in the printing head 1 comprises a plurality of orifices. An ink tank 2 is mounted in the rear of the carriage 3 to supply ink to the printing head 1.

Printing signals are sent through a cable 32 to the carriage 3 from a control section. The carriage 3 is placed in the home position 3A when the printer is in standby mode for printing, turned off, or packed for transportation.

The printer is equipped with a nozzle orifice protective apparatus 100 with a cap member 5 at the position facing the carriage 3 in the home position 3A so as to cover the printing head nozzle. A tank 28 is provided at the lower part of the home position 3A to store maintenance solution to be supplied to the nozzle orifice protective apparatus 100 and waste liquid returned from the printing head 1 and the apparatus 100.

Construction of the printing head 1 and nozzle orifice protective apparatus 100 will be described further in detail with reference to FIG. 2.

The carriage 3 includes a gate valve 2*a* in an ink passage 2*c* communicating between the printing head 1 and the ink tank 2 in the rear of the printing head 1. It also contains an ink cartridge 30 for recharging the ink tank 2 with ink, and an electrode 2*d* for detecting the presence of ink in the ink tank 2. The gate valve 2*a* is normally forced by a spring 2*b* to open the ink passage 2*c*. When an external force is applied on the operating axis of the gate valve 2*a* against the force of the spring 2*b*, the gate valve 2*a* closes the ink passage 2*c*.

The above assembly of the ink cartridge 30, ink tank 2, ink passage 2*c* and gate valve 2*a* is provided independently by numbers corresponding to the number of nozzle blocks in the printing head 1. In a color ink jet printer, for instance, the printing head 1 contains nozzle blocks each corresponding to yellow, magenta, cyan or black ink, and the above assembly is provided independently for each nozzle block.

In the printing head 1, ink from each ink passage 2*c* is led through a nozzle capillary 1*a* into an ink chamber 1*b*. The ink is then sprayed through a nozzle orifice 1*d* by means of an adjacent piezoelectric element 1*c*.

The specific construction of the nozzle orifice protective apparatus 100 is as follows. The cap member 5 for covering the printing head nozzle face contains a chamber 5*b* with open front. Rubber or the like shock absorbing sealing member 5*a* is provided on the periphery of the opening.

The chamber 5*b* with the opening in the cap member 5 is divided into several chamber blocks to correspond to the nozzle blocks. A check valve 5*c* is provided in the inlet port of the chamber 5*b* through which maintenance solution is supplied. A check valve 5*d* is provided in the outlet port of the chamber 5*b* which is connected to a suction pipe 23 for depressurizing the chamber 5*b* to a negative pressure.

The cap member 5 is rotatably supported by a supporting arm 19 which is pivotally supported at its lower end by the frame. The cap member 5 is always forced by a pair of springs 18*a* and 18*b* toward the direction away from the printing head 1. When a force is applied against the springs 18*a* and 18*b* onto the cap member 5 toward the printing head 1, the cap member 5 shifts, with the supporting arm 19 as a moving axis, to cover the nozzle face of the printing head 1.

The nozzle orifice protective apparatus 100 is further provided with a DC motor 8 as a prime mover. By changing over its polarity, the motor 8 rotates alternatively in the normal (clockwise) or reverse (counterclockwise) direction.

A vacuum pump 31 is mounted in connection with the motor 8. The vacuum pump 31 comprises a cylinder 9*a*, a piston 9*b*, check valves 9*c* and 9*d*, a piston rod 9*e*, a gear 9*f* and a pump chamber 9*g*. The motor 8 is directly connected with a gear 10 which transmits rotation of the motor 8 to the gear 9*f* in the vacuum pump 31.

The inlet and outlet of the vacuum pump 31 are coupled with flexible pipes 23 and 24, respectively. The pipes 23 and 24 are made of synthetic resin. The other end of the pipe 23 connected to the inlet (suction port) of the pump 31 is connected to the outlet of the chamber 5*b* in the cap member 5. The other end of the pipe 24 connected to the outlet (discharge port) of the pump 31 is connected to a waste collecting section 27 in the tank 28.

Furthermore, a moving mechanism is provided in connection to the DC motor 8 to shift the cap member 5.

A pulley 11 which is directly connected to the motor 8 transmits the rotation of the motor 8 to a cam shaft 13 through a belt 12 and a pulley-equipped one way clutch 14 which serves to transmit either normal or reverse rotation of the motor 8 to the cam shaft 13. (In the present embodiment, only the clockwise rotation viewed from the front of FIG. 2 is transmitted to the cam shaft 13.)

Eccentric cams 15, 16 and 17 are directly connected with the cam shaft 13. The cam 15 functions to shift the cam member 5 to tightly cover the printing head 1, the cam 16 to cause the gate valve 2*a* to close via a valve lever 20, and the cam 17 to turn on or off a micro switch 21.

The valve lever 20 is rotatably supported at its center by a pivot 20*a* on the frame. One end of the valve lever 20 is made in contact with the circumference of the eccentric cam 16, the other end thereof being positioned on the operating axis of the gate valve 2*a*. Accordingly, when the cam 16 rotates, actuating the valve lever 20 to turn counterclockwisely with the pivot 20*a* as the fulcrum, the other end of the valve lever 20 depresses the gate valve 2*a* at the operating axis against the force of the spring 2*b*, thus causing the gate valve 2*a* to close the ink passage 2*c*.

The micro switch 21 detects the rotation angle of the cam shaft 13. The tank 28 comprises the maintenance solution tank 26 for storing maintenance solution (water or other solvent) and the waste tank 27.

A flexible pipe 22*a* is connected to the maintenance solution tank 26. The other end of the pipe 22*a* is connected to a solenoid valve 7 which is connected via a pipe 22*b* to the chamber 5*b* in the cap member 5. Accordingly, when the solenoid valve 7 opens, maintenance solution is led from the tank 26 through the pipes 22*a* and 22*b* into the chamber 5*b* in the cap member 5.

Waste liquid from the printing head 1 and the cap member 5 is collected by a gutter 29 and led into the waste tank 27 through a flexible pipe 25. Waste liquid sent through the pipe 24 from the vacuum pump 31 is also led into the waste tank 27.

The pipe 23 communicating between the cap member 5 and the vacuum pump 31 is connected with a split pipe 23a on the way. The split pipe 23a is led to the atmosphere through a solenoid valve 6.

Figure 3:
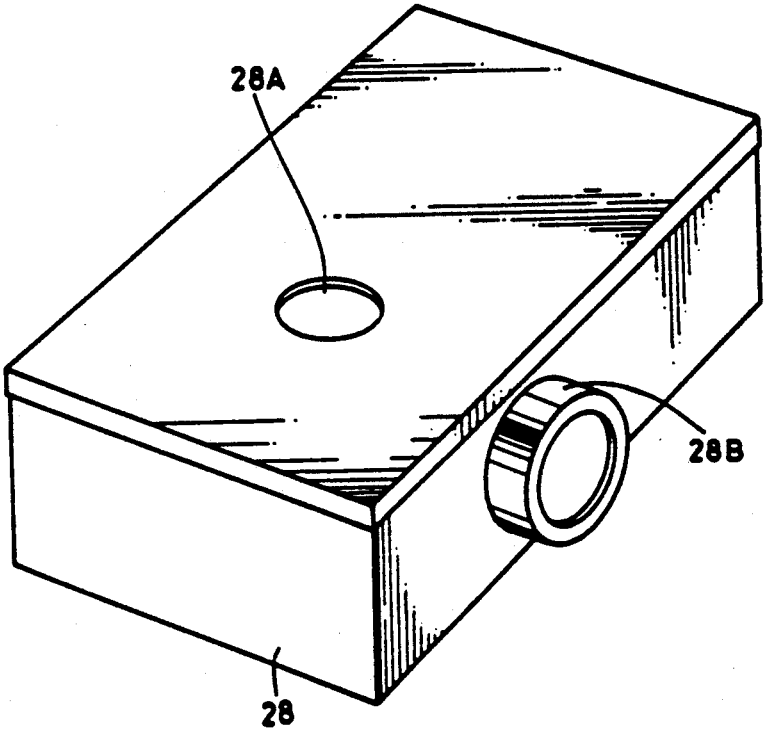
FIG. 3 is a perspective view showing the construction of a tank of the nozzle orifice protective apparatus of FIG. 2.
Figure 4:
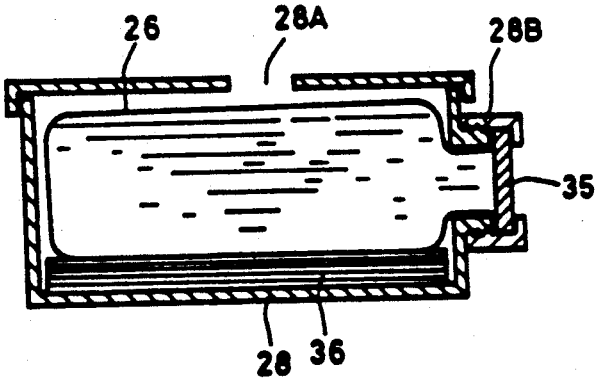
FIG. 4 is a sectional view of the tank of FIG. 3.

FIG. 3 is a perspective view of the tank 28, and FIG. 4 is a sectional view of the tank 28.

The tank 28 has a waste collecting port 28A in the top wall and a joint port 28B for connection with the pipe 22a in a side wall. Maintenance solution is supplied from the maintenance solution tank 26 through the joint port 28B.

The maintenance solution tank 26 installed within the tank 28 is made of soft material such as resin which is blow molded into a flexible bag with its open end portion being somewhat thicker than the rest. The opening of the bag is closed by a rubber seal 35 and positioned in the joint port 28B.

The maintenance solution tank (bag) 26 contains a small amount of gas together with maintenance solution.

The waste collecting section 27 is a space outside the maintenance solution tank 26 but within the tank 28. A water absorbing polymer 36 is placed on the bottom of the waste collecting section 27.

The water absorbing polymer 36 ("Super Love" by Asahi Chemical Industry Co., Ltd. may be used, for instance.) absorbs 70 cc of electrolyte for each 1 gram of the polymer. If liquid to be absorbed is pure water, the water absorbing polymer 36 absorbs it by 700~1,000 times the weight of the polymer. The polymer 36 which has absorbed liquid becomes gel.

Figure 5:
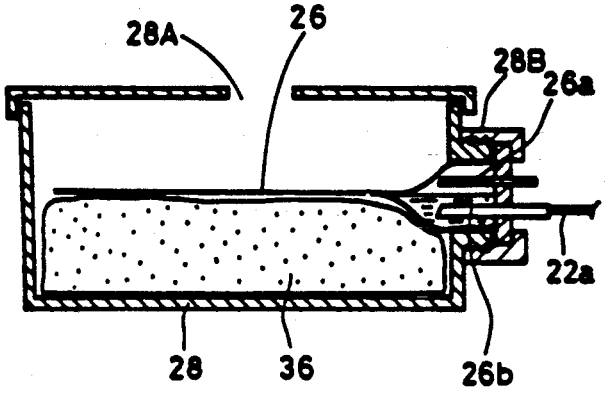
FIG. 5 shows the tank in the operation mode.

When the tank 28 is set in the predetermined place of the printer, the end of the pipe 22a is positioned in the maintenance solution tank 26, passing through the seal rubber 35, as shown in FIG. 5, and the waste collecting port 28A meets the pipes 25 and 24.

The tank 28 is therefore detachable from the printer. Maintenance solution can be recharged and waste liquid can be disposed by replacing the tank 28.

Moreover, when the tank 28 is set on the printer, electrodes (sensors) 26a and 26b are positioned in the maintenance solution tank 26, passing through the rubber seal 36, to detect the amount of solution remaining in the tank 26. The electrode 26b is made of metal pipe and mounted at the end of the pipe 22a.

The electrodes 26a and 26b are conducting in the maintenance solution. Detection of the solution shortage is performed based on this property. That is, when the electrodes are not conducting, it means that the maintenance solution is running short.

Operation of the nozzle orifice protective apparatus shown in FIG. 2 is detailed below. When the printer is out of service with power OFF or when it is in standby mode with power ON, the nozzle orifice protective apparatus 100 operates as follows.

First, power is supplied to the solenoid valve 6 to open (SV 1 ON) so that atmospheric pressure is achieved in the pipe 23 and pump chamber 9g. When power is supplied to the motor 8 to run clockwise with this state, the cam shaft 13 rotates clockwise due to the function of the one way clutch 14. Then, the gate valve 2a in the ink tank is closed through the valve lever 20 by rotation of the eccentric cam 16, so that the ink passage 2c is isolated from the ink tank 2. At the same time, rotation of the eccentric cam 15 causes the cap member 5 to move toward the printing head 1, tightly sealing the same.

At this stage, the eccentric cam 17 actuates the rotation angle-detecting micro switch 21 ON so that power supply to the motor 8 and solenoid valve 6 is interrupted. Meanwhile the gate valve 2a and cap member 5 maintain the current states. Namely, the cap member 5 closely seals the printing head 1 and the chamber 5b in the cap member 5 is effected atmospheric pressure. To prevent air from entering the nozzle due to air pressure, the gate valve 2a is closed before the printing head 1 is sealed by the cap member 5.

Then, power is supplied to the DC motor 8 to run counterclockwise. This time, the cam shaft 13 does not rotate because of the function of the one way clutch. Rotation of the gear 10 actuates the vacuum pump 31, while the eccentric cam 15, 16 and 17 maintain their current positions. Power is supplied to the motor 8 for a predetermined period until the pressure in the chamber 5b of the cap member 5 and in the pipes 22b and 23 reduces to a predetermined value near the vacuum state due to the pump operation. At this stage, the motor 8 is turned off, and power is supplied to the solenoid valve 6 for a short period of time so that the atmospheric pressure is effected in the pipe 23 and pump chamber 9g. This helps prevent maintenance solution from flowing to unnecessary parts such as the pipe 23 and pump chamber 9g during the following maintenance solution filling process, thus saving maintenance solution.

Then, power is supplied to the solenoid valve 7 to open for a predetermined period. Since the pressure in the pipe 22b and chamber 5b of the cap member 5 is near the vacuum, maintenance solution is sucked from the maintenance solution tank 26 through the pipes 22a and 22b into the chamber 5b, filling the nozzle orifice. Consequently, ink in the nozzle is protected from dryness and solidification, air is blocked from entering the nozzle, and the nozzle orifice is protected from contamination.

When printing is started, the nozzle orifice protective apparatus 100 operates as follows.

First, power is supplied to the solenoid valve 6 to open, achieving the atmospheric pressure in the pipe 23 and pump chamber 9g. When power is supplied to the DC motor 8 to run clockwise with this state, the cam shaft 13 rotates clockwise, whereby the closed gate valve 2a is opened and the cap member 5 is released from the printing head 1 by the functions of the eccentric cams 15 and 16, respectively. At this stage, the micro switch 21 is turned OFF so that power supply to the motor 8 and solenoid valve 6 is interrupted.

Waste liquid such as waste maintenance solution and waste ink flowing from the chamber 5b of the cap member 5 is collected in the gutter 29 and led through the pipe 25 into the waste collecting section 27. Now, the printing head 1 is ready for printing operation.

As shown in FIG. 5, the maintenance solution tank (bag) 26 gradually shrinks as the maintenance solution is consumed while the water absorbing polymer 36 absorbs waste liquid entering the tank 28 through the waste collecting port 28A.

Accordingly, the maintenance solution tank 26 reduces in volume as the amount of maintenance solution decreases. In contrast, the volume of collected waste liquid increases and the polymer 36 which has absorbed the waste liquid becomes gel.

When the amount of maintenance solution remaining in the tank 26 reduces below a specified level, the electrodes 26a and 26b detect it, facilitating the timely replacement of the tank 28.

The tank 28 can be replaced by being disconnected from the printer. Since the water-absorbing polymer 36 in the waste collecting section has become gel by absorbing waste liquid, waste liquid never leak through the waste collecting port 28A and joint port 28B if the tank is jolted or inclined when disconnected from the printer. This is convenient for the tank 28 replacement.

In the above embodiment, the maintenance solution tank 26 and waste collecting section 27 are located in the same tank 28. Alternatively, they may be disposed in separate tank cases.

Since the maintenance solution tank 26 is made of a flexible bag, the portion that has become empty as maintenance solution is used is pressed, gradually forcing the solution toward the joint port 28B side, as indicated in FIG. 5.

The maintenance solution tank 26 contains a specified volume of gas as mentioned earlier. Therefore, when the maintenance solution has reduced below a predetermined level, conductivity between the electrodes 26*a* and 26*b* is completely lost because there is no conducting medium between the electrodes 26*a* and 26*b* as shown in FIG. 5. Reduction of the maintenance solution below the specified level is thus detected.

Figure 6:
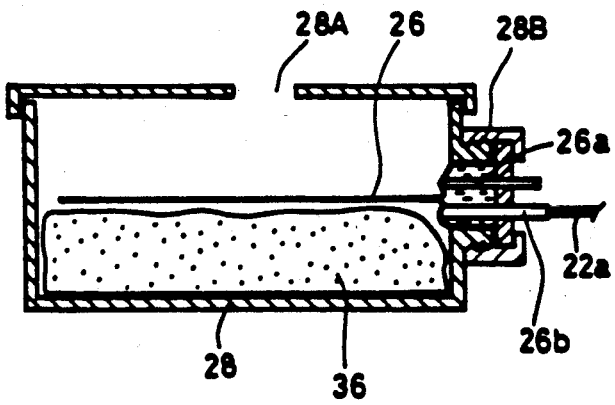
FIG. 6 shows an example of a tank into which gas is not sealed.

If there was no gas contained in the maintenance solution tank 26, the electrodes 26*a* and 26*b* would continue conducting through the maintenance solution even after the solution has reduced below the specified level, as illustrated in FIG. 6. In such a case, the electrodes 26*a* and 26*b* would output a signal indicating as if there was sufficient amount of maintenance solution in the tank 26. Consequently, required amount of maintenance solution could not be supplied to the cap member 5. In other words, the electrodes 26*a* and 26*b* could not detect reduction of the maintenance solution below the specified level properly.

Since the maintenance solution tank 26 in the present invention contains the specified volume of gas as well as maintenance solution, reduction of the solution below the specified level can be accurately detected.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A nozzle orifice protection apparatus comprising a cap member;

a waste collecting tank;

means connecting said waste collecting tank to said cap member for conducting waste liquid from said cap member to said waste collecting tank;

a water-absorbing polymer disposed in said waste collecting tank and being contacted by said waste liquid;

said water-absorbing polymer having the capability of absorbing water in the amount of 700 to 1000 times the weight of the polymer and said water-absorbing polymer which has absorbed liquid becoming gel;

a tank containing maintenance solution located in said waste collecting tank and occupying space therein;

means for withdrawing maintenance solution from said maintenance solution tank and providing it to said cap member;

said maintenance solution tank being formed of a flexible bag which decreases in size as said maintenance solution is withdrawn; and said water-absorbing polymer forming gel and expanding as it absorbs waste maintenance fluid into the space previously occupied by said flexible bag as it decreases in size upon maintenance solution being withdrawn.

2. A nozzle orifice protection apparatus as recited in claim 1, wherein said flexible bag is partially filled with gas.

3. A nozzle orifice protection apparatus as recited in claim 2 wherein a pair of electrodes are located in said flexible bag.

4. A nozzle orifice protection apparatus comprising:

a cap;

a waste collecting tank connected to said cap and deposited under said cap, having an unrestricted open interior space, a waste collecting port on top of said waste collecting tank, and a joint port on a side of said waste collecting tank;

a maintenance solution tank for containing maintanance solution, located in said unrestricted open interior space and under said waste collecting port, formed of a flexible bag, partially filled with gas, and having an opening in said joint port;

a pair of electrodes located in said opening;

a water-absorbing polymer disposed under said maintenance solution tank in said unrestricted open interior space;

a seal member positioned in said joint port for closing said opening;

means for providing maintenance solution from said maintenance solution tank to said cap through said seal member; and means for collecting waste from said cap to said waste collecting tank through said waste collecting port.

* * * * *